US006068670A

United States Patent [19]

Haupais et al.

[11] Patent Number: 6,068,670

[45] Date of Patent: May 30, 2000

[54] EMULSIFIED FUEL AND ONE METHOD FOR PREPARING SAME

[75] Inventors: Alain Haupais, La Tour de Salvagny; Philippe Schulz, Saint-Foy-les-Lyon; Pascal Brochette, Pau, all of France

[73] Assignee: Elf Antar France (Societe Anonyme), Courbevoie, France

[21] Appl. No.: 09/147,031

[22] PCT Filed: Mar. 17, 1997

[86] PCT No.: PCT/FR97/00475

§ 371 Date: Nov. 23, 1998

§ 102(e) Date: Nov. 23, 1998

[87] PCT Pub. No.: WO97/34969

PCT Pub. Date: Sep. 23, 1997

[30] Foreign Application Priority Data

Mar. 15, 1996 [FR] France ..... 96 03547

[51] Int. Cl.[7] ..... C10L 1/32

[52] U.S. Cl. ..... 44/301; 366/176.1

[58] Field of Search ..... 44/301; 366/176.1

[56] References Cited

U.S. PATENT DOCUMENTS

| | | | |
|---|---|---|---|
| 2,509,288 | 5/1950 | Brochner | 366/176.1 |
| 3,606,868 | 9/1971 | Voogd | 44/301 |
| 4,352,572 | 10/1982 | Chen et al. | 366/340 |
| 4,708,720 | 11/1987 | Grangette et al. | 44/301 |
| 4,755,325 | 7/1988 | Osgerby | 44/301 |
| 5,000,757 | 3/1991 | Puttock et al. | 44/301 |
| 5,411,558 | 5/1995 | Taniguchi et al. | 44/301 |

FOREIGN PATENT DOCUMENTS

| | | |
|---|---|---|
| 8768705 | 2/1987 | Australia . |
| 630398 | 8/1992 | European Pat. Off. . |
| 52-069909 | 6/1977 | Japan . |

*Primary Examiner*—Jacqueline V. Howard
*Attorney, Agent, or Firm*—Dennison, Scheiner, Schultz & Wakeman

[57] ABSTRACT

A novel fuel which is an emulsion of water in at least one hydrocarbon, and which contains an emulsifying system containing at least one sorbitol ester, at least one fatty acid ester and at least one polyalkoxylated alkylphenol. The system has an overall HLB of between 6 and 8, and the emulsion contains droplets of aqueous disperse phase which are less than or equal to 3 $\mu$m in size.

34 Claims, 3 Drawing Sheets

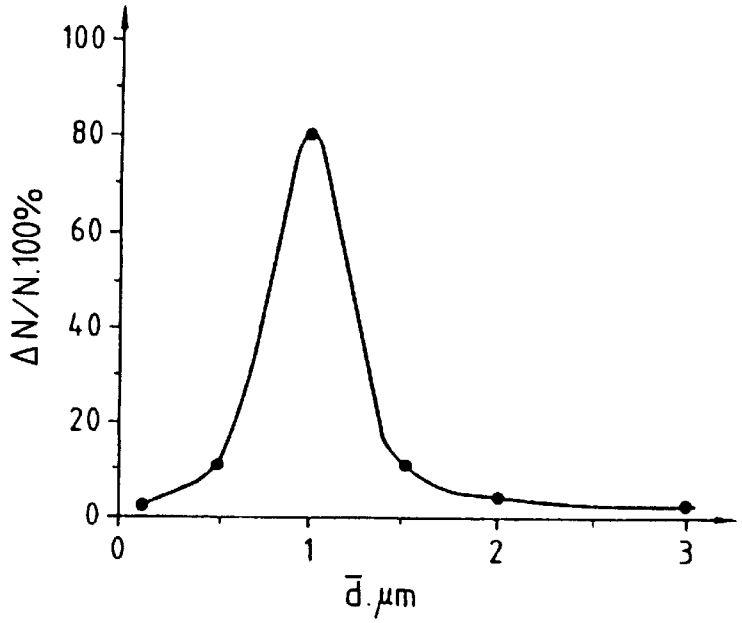
FIG.5
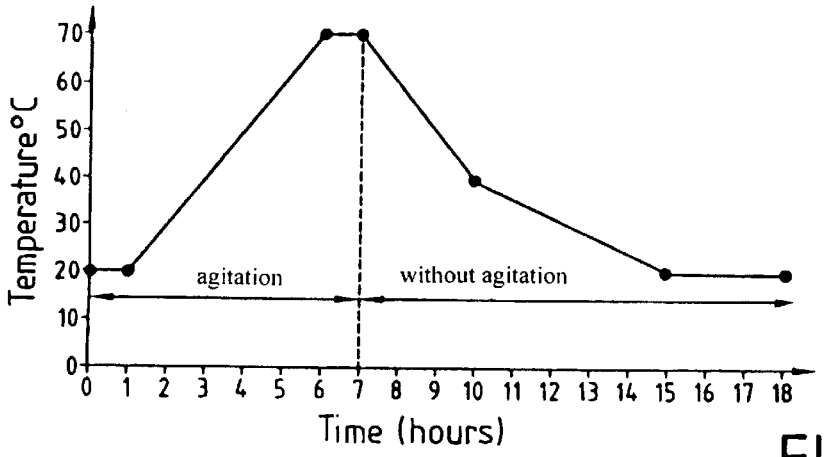
FIG.6.1
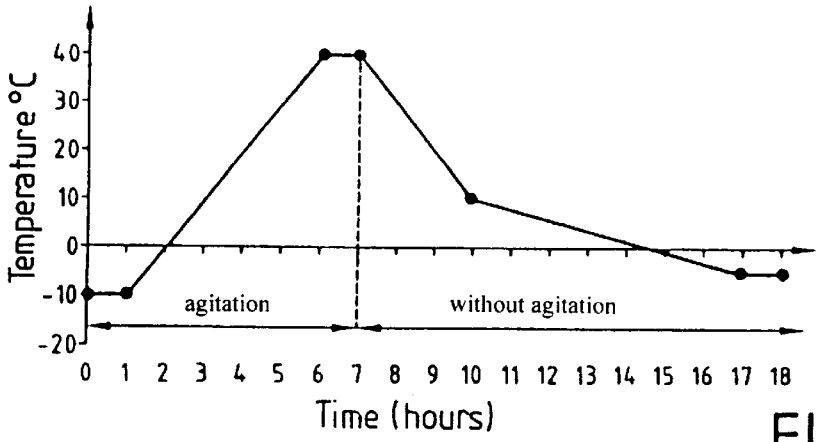
FIG.6.2

EMULSIFIED FUEL AND ONE METHOD FOR PREPARING SAME

BACKGROUND OF THE INVENTION

1. Field of the Invention

The field of the present invention is that of fuel compositions and particularly fuels intended for use in heat engines. More precisely, the fuels envisaged within the framework of the invention contain predominantly liquid hydrocarbons and especially:

those of mineral origin, such as petroleum derivatives of the types comprising petrols, diesel fuels, kerosenes and heating oils, and/or such as those derived from coal or gas (synthetic engine fuels);

those of vegetable origin, such as esterified or non-esterified vegetable oils;

and mixtures thereof.

The present invention relates more specifically to novel fuel compositions consisting of emulsions of water in at least one hydrocarbon and generally in a mixture of hydrocarbons, for example the mixture of which diesel fuel is composed.

The present disclosure will therefore deal with stabilized water/hydrocarbon emulsions comprising surfactants capable of emulsifying and of stabilizing such emulsions.

The present invention further relates to a method of preparing emulsified water/hydrocarbon fuels (e.g. engine fuels) combined with one or more surfactants.

2. Description of Related Art

The present invention comes within the field, which has long been fashionable, of developing fuel compositions, especially engine fuel compositions, comprising substitute products for petroleum derivatives, with the aim of reducing costs and limiting pollution.

Water was very quickly found to be a valuable additive or partial substitute for petrol or diesel fuel. Water is in fact an inexpensive and non-toxic liquid which has proved capable of reducing fuel consumption and the emission of visible or invisible pollutants.

Despite all these assumed advantages, no water/hydrocarbon engine fuel has yet been used industrially, on a large scale, in concrete applications because of prohibitive difficulties with their processing and use.

According to a first approach, it has been envisaged to make provision for storing water and fuel separately on the vehicle and mixing them at the time of use. This approach requires the installation, on board the vehicle, of a complex and sophisticated device for carrying out specific mixing and metering operations. The cost, bulk and delicacy of such devices have proved totally dissuasive in the development of this approach.

The second ponderable approach consists in using ready-made mixtures of water and fuel, but this did not reckon with the considerable problems of the storage stability of such mixtures at temperatures ranging from −20° C. to −70° C., and of the stability of the emulsion in a tank under use conditions.

Thus there are many unfruitful technical proposals which aimed, in vain, to provide emulsified engine fuels comprising water and, more generally, novel non-polluting engine fuels resulting in low consumption.

As an illustration of one such prior art, there may be mentioned French patent application Ser. No. 2 470 153, which discloses an emulsified engine fuel comprising hydrocarbons, water, an alcohol (methanol, ethanol) and an emulsifying system formed of sorbitan monooleate and ethoxylated nonylphenol. The concentration of the emulsifying system in the emulsion is between 3 and 10% by volume. The essential presence of alcohol in this emulsion constitutes an extremely penalizing factor, especially as regards the economics and the engine performance characteristics capable of being obtained with this emulsion. Moreover, it should be noted that the stability of this water-alcohol/hydrocarbon emulsion leaves something to be desired. In fact, after the emulsion has been stored for 72 hours, which corresponds to a realistic period of non-use of a vehicle running on this fuel, there is an incipient phase separation (dephasing/demixing) between the hydrocarbons and the aqueous-alcoholic mixture. The hydrocarbons dephased (separated out) at the end of this time can represent up to 3% by volume of the emulsion. It is easy to imagine that, after a few days' storage, the dephasing of this emulsion according to patent application No. 2,470,153 is sufficient to prohibit the running of the vehicle under normal conditions of application.

U.S. Pat. No. 4,877,414 has further disclosed an emulsified engine fuel containing a number of additives, including an emulsifying system formed of sorbitan sesquioleate, sorbitan monooleate and the polyoxyethylene ether (6 EO) of dodecyl alcohol. Preferably, according to said patent, the total concentration of all the additives is about 2.1%. The other additives which can be employed apart from the emulsifying system are a mono-α-olefin (1-decene), methoxymethanol, toluene, an alkylbenzene and calcium hydroxide. This formulation is extremely complex, if only for the number of additives employed. It is also relatively expensive. Finally, the emulsified fuel according to said patent again suffers from a lack of stability, particularly at low temperature. The Applicant was moreover able to demonstrate this clearly by reproducing the preferred embodiment of the emulsified fuel according to said U.S. patent. It was found that the emulsion separates (dephases) in one hour. The phenomenon is further exacerbated at low temperatures below 5° C. It is therefore hardly imaginable what might happen in vehicle tanks containing this emulsion when placed under real winter use conditions.

The abstract of Japanese patent no. 77-69 909, given in Chemical Abstract 87 : 138 513 x, relates to an emulsified engine fuel (kerosene/water) comprising sorbitan sesquioleate and the polyethylene glycol ether of nonylphenol as emulsifiers. The size of the droplets of aqueous disperse phase is $\leqq 20\mu$ with a mean value of the order of $10\mu l$. This technical proposal is again incapable of suitably satisfying the objectives of physicochemical stability, limitation of pollution, cost reduction and reduction of fuel consumption. This technical teaching can therefore provide no help for those skilled in the art working in the prospective field of the invention.

Another Chemical Abstract, no. 101 : 57 568 z, summarizing Brazilian patent no. 82 4 947, relates to an emulsified fuel comprising hydrocarbons consisting of extremely viscous and heavy petroleum derivatives, water, ethanol and an emulsifier consisting of ethoxylated nonylphenol. This emulsified fuel is intended for use in conventional furnaces and heating oil burners. This fuel cannot meet the expected performance specifications of combustion, limitation of pollutants and low consumption. Moreover, the physicochemical stability of this emulsion is poor.

PCT international patent application WO-93/18117, in the name of the Applicant, describes emulsified fuels which the present invention proposes to improve.

These emulsified fuels, which can be engine fuels, comprise specific amounts of hydrocarbons and a minor amount of a group of additives, including especially an emulsifying system comprising sorbitan oleate, polyalkylene glycol and alkylphenol ethoxylate. The disperse phase of these emulsified fuels consists of water present in a proportion of 5 to 35% by weight, while the additives are present in a proportion of 0.1 to 1.5% by weight.

The concentration ranges (in % by weight) of sorbitan oleate, polyalkylene glycol and alkylphenol ethoxylate are respectively 0.20–0.26/0.20–0.25/0.20–0.27. The entire patent application states that these three principal additives are used in equal amounts: 1/1/1.

The performance characteristics of these known emulsified fuels, in terms of stability, reduction of visible and invisible pollutants, reduction of consumption and cost reduction, are totally capable of improvement. In particular, research and development on these emulsified engine fuels has made it possible to show that improvements in terms of the cost and stability of the emulsion are desirable, especially under real use conditions in a vehicle.

This review of the prior art has shown that there is an unsatisfied need for an emulsified fuel which is physicochemically stable (no dephasing), creates low pollution, is economical and reduces consumption.

Confident of this observation, the Applicant therefore set itself a number of objectives, which will be listed below.

One of the essential objectives of the present invention is to rectify this omission by providing an emulsified fuel, particularly an engine fuel, formed of a stable water/hydrocarbon emulsion which remains perfectly homogeneous over long periods of time, both in storage tanks and in elements of the circuits making up the combustion devices in which said fuels may be used.

Another essential objective of the present invention is to provide novel improved emulsified engine fuels which give good results in terms of reducing the fuel consumption and reducing the emission of visible pollutants, i.e. smoke and solid particles, and gaseous invisible pollutants such as CO, $NO_x$ and/or $SO_2$, unburnt hydrocarbons and $CO_2$.

Another essential objective of the present invention is to provide novel emulsified fuels which have a low cost price so as not to wipe out the advantage gained by the partial replacement of expensive hydrocarbons with water.

Another objective of the present invention is to provide a method of preparing stable, non-polluting and economical emulsified fuels, it also being necessary for said method to be inexpensive and furthermore easy to carry out, without a sophisticated operating protocol or device.

In said context, the Applicant pursued its inventive efforts and developed novel improved emulsified fuels, the original features being as follows:

On the one hand the fuels have an aqueous disperse phase consisting of droplets of reduced size which possess an interfacial film for dealing with the phenomenon of coalescence. It is also essential, in terms of the stability of the emulsion, for the size distribution of the water droplets to be as narrow as possible.

On the other hand the chosen composition of the emulsifying system is a contributing factor in achieving the specifications of stability, size and size distribution droplets of the aqueous phase in the diesel fuel phase.

SUMMARY OF THE INVENTION

It follows from this that the present invention relates to an improved emulsified fuel consisting of an emulsion of water in at least one hydrocarbon, said fuel being characterized in that:

→this emulsion contains an emulsifying system comprising:

Δ (I) at least one sorbitol ester of the general formula (I)

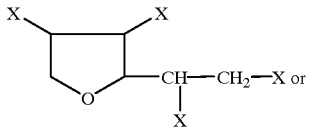

(I')

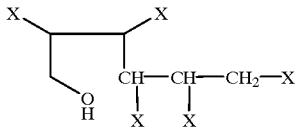

in which:

the radicals X are identical to or different from one another and are each OH or $R^1COO$—, where $R^1$ is a linear or branched, saturated or unsaturated, aliphatic hydrocarbon radical optionally substituted by hydroxyls and having from 7 to 22 carbon atoms, $R^1$ preferably being a fatty acid residue without a terminal carboxyl, this ester (I) having an HLB of between 1 and 9;

Δ (II) at least one fatty acid ester of the general formula (II)

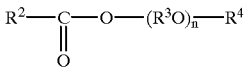

in which:

$R^2$ is a linear or branched, saturated or unsaturated, aliphatic hydrocarbon radical optionally substituted by hydroxyl groups and having from 7 to 22 carbon atoms, $R^2$ preferably being a fatty acid residue without a terminal carboxyl, $R^3$ being a linear or branched $C_1$–$C_{10}$ alkylene, preferably $C_2$–$C_3$ alkylene, n is an integer greater than or equal to 6 and preferably between 6 and 30, and $R^4$ is H, linear or branched $C_1$–$C_{10}$ alkyl or

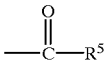

where $R^5$ is as defined above for $R^2$, this ester (II) preferably having an HLB greater than or equal to 9; and Δ (III) at least one polyalkoxylated alkylphenol of the general formula

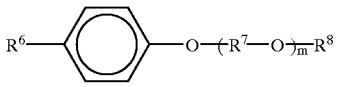

in which:

$R^6$ is a linear or branched $C_1$–$C_{20}$ alkyl, preferably $C_5$–$C_{20}$ alkyl, m is an integer greater than or equal to 8 and preferably between 8 and 15, and $R^7$ and $R^8$ are respectively as defined above for $R^3$ and $R^4$ of formula (II), this ester (III) preferably having an HLB of between 10 and 15;

→this emulsifying system has an overall HLB of between 6 and 8, preferably of between 6.5 and 7.5;

→and the emulsion is prepared in such a way that the mean size of the droplets of aqueous disperse phase is less than or equal to 3 μm, preferably 2 μm and particularly preferably 1 μm, with a standard deviation of less than 1 μm.

These advantageous and innovative characteristics relating to:

the dimensional profile of the droplets of aqueous phase and the inventive choice of an appropriate composition for the emulsifying system are very clearly differentiated from the invention according to WO 93 18 117, which is improved by the present invention.

The improved emulsified engine fuels possessing these characteristics benefit from a high storage stability over long periods of time. They do not dephase (undergo phase separation), either in tanks or in the various elements making up the feed circuits of devices capable of acting as seats of combustion, namely internal combustion engines, burners, etc.

The emulsion according to the invention remains perfectly homogeneous, so the risks of unwanted conditions in the combustion devices are extremely limited. This absence of dephasing (phase separation) and coalescence, whether by gravity or by any other separation means (filtration, centrifugal effect, etc.), constitutes a major technical advance which enables serious industrial and commercial applications to be envisaged in concrete terms.

These are real improvements compared with the emulsified engine fuel according to WO 93 18 117.

In terms of the present invention, the stability of the emulsion is understood as meaning the maintenance of the emulsion in its initial, homogeneous physicochemical state (no dephasing, no coalescence of the droplets of disperse phase) during storage for at least 3 months at room temperature.

Furthermore, the emulsified fuels according to the invention simultaneously bring extremely valuable and satisfactory performance characteristics as regards the reduction of polluting emissions and consumption and achieve this at a reasonable cost price.

It should be noted that these acquisitions have not been obtained to the detriment of the combustion performance characteristics (high-level thermal and thermomechanical efficiency).

Also, the absence of large droplets makes it possible to minimize the problems of clogging, pressure loss and/or water separation in the filtering means such as those which can be found in feed circuits for emulsified fuel. Moreover, these problems are exacerbated under conditions of intense cold, causing the droplets of aqueous phase to freeze; this results in the formation of beads, which have a greater capacity to clog than liquid droplets. The damage caused by freezing of the droplets can be minimized by the addition of antifreezes.

Fixing the mean diameter of the droplets of aqueous phase at 3 μm, preferably 1 μm and particularly preferably 1 μm, with a maximum standard deviation of 1 μm, appears to be one of the determining factors in guaranteeing the stability of the emulsion and particularly the limitation of coalescence and dephasing phenomena. According to the invention, provision is therefore made for a <<monodisperse>> particle size profile around 1 μm in practice (cf. curve of FIG. 5). This means that the population of droplets is homogeneous in size, the latter additionally being sufficiently small to be a contributing factor to the stability.

In terms of the present invention, the abbreviation HLB denotes "Hydrophile-Lipophile-Balance". This is a well-known parameter for characterizing emulsifiers. The reference work in the field of emulsions, namely: "EMULSIONS: THEORY AND PRACTICE. Paul BECHER—REINHOLD Publishing Corp.—ACS Monograph—ed. 1965", gives a detailed definition of HLB in the chapter "The chemistry of emulsifying agents"—p. 232 et seq. This definition is incorporated in the present disclosure by way of reference.

DETAILED DESCRIPTION OF THE INVENTION

The qualitative and quantitative composition of the emulsifying system is also an essential feature of the invention, which contributes to the results obtained, especially as regards the stability.

Advantageously the emulsion comprises at least 5% by weight of water and the concentration of the emulsifying system relative to the total weight of the fuel is less than or equal to 3% by weight, preferably less than or equal to 2% by weight.

In a preferred embodiment of the invention, the emulsifying system comprises the 3 compounds (I), (II) and (III) in the following proportions:

(I) from 2.5 to 3.5 parts by weight, preferably 3 parts by weight, (II) from 1.5 to 2.5 parts by weight, preferably 1.5 to 2 parts by weight, (III) from 0.5 to 1.9 parts by weight, preferably 0.5 to 1.5 parts by weight.

The fatty acid ester of sorbitan (I) preferably consists essentially of one or more $C_{18}$ sorbitan oleates optionally associated with one or more $C_{18}$ (linoleic, stearic) and $C_{16}$ (palmitic) fatty acid esters. Of course, the ester (I) is not limited to the fatty acid monoesters of sorbitan but also covers the diesters and/or triesters and mixtures thereof Whatever the case may be, one of the selection criteria for this ester (I) is advantageously that it belongs to the HLB range between 1 and 9, which gives it a marked lipophilic tendency. The more particularly preferred HLB for the ester (I) is between 2.5 and 5.5.

In practice, preference is therefore given to mixtures of esters consisting essentially of sorbitan oleates and, in smaller amounts, sorbitan palmitate, stearate and linoleate. Thus one possible example is sorbitan sesquioleate of the type marketed under the trade mark SPAN 83® or ARLACEL 83® (ICI).

Other examples of sorbitan esters (I) which may be mentioned are sorbitan laurates of the type marketed under the trade mark SPAN 20® or ARLACEL 20® (ICI) or ALKAMULS SML (RHONE POULENC) and sorbitan stearates of the type marketed under the trade mark ARLACEL 60® (ICI) or ALKAMULS SMS (RHONE POULENC), although this is not an exhaustive list.

It is self-evident that, in terms of the present invention, the esters (I) also cover all the analogs and derivatives of fatty acid esters of sorbitan.

As far as the compound (II) is concerned, this is selected from polyalkylene glycol and preferably polyethylene glycol (PEG) oleates and/or stearates and/or ricinoleates, preferably from those in which the PEG has a molecular weight less than or equal to 450, preferably of the order of 300.

Thus one possible example is PEG 300 monooleate of the type marketed under the trade mark TILOL 163® (UNION DERIVAN SA) or EMULSOGEN A® (HOECHST). Other examples of compounds (II) which may be mentioned are PEG 400 monooleate of the type marketed under the trade mark SECOSTER MO 400 (STEPAN) or REMCOPAL (CECA), stearic acid ethoxylated with 8 ethoxy units (=PEG 350 stearate) of the type marketed under the trade mark SIMULSOL M45° (SEPPIC) or MYRJ 45® (ICI) and PEG ricinoleate of the type marketed under the trade mark CEREX EL 4929® (AUSCHEM SpA) or MARLOSOL R70® (HÜLS AG, STEPAN).

The alkylphenol alkoxylate (III) is preferably selected from polyethoxylated nonylphenols and/or octylphenols, polyethoxylated nonylphenols being particularly preferred.

In practice, it is e.g. nonylphenol ethoxylate. It can advantageously be replaced or associated with one or more other alkylphenol alkoxylates. Thus it is advantageous to select the alkylphenol alkoxylates (III) in which the alkyl radical substituting the phenol contains about 1 to 20 carbon atoms, preferably 5 to 20 carbon atoms. Moreover, it is also preferable to select the alkylphenol alkoxylates (e.g. ethoxylate) in which the alkoxy chain contains preferably from 8 to 20 and particularly preferably from 8 to 15 alkylene oxide (e.g. ethylene oxide) groups per molecule.

In practice, preference is thus given to the polyethoxylated nonylphenol $C_9H_{19}$—$C_6H_4$—$(OCH_2CH_2)_m$—OH where $8<m<15$. In fact, it appears to be essential, within the framework of the invention, to use polyethoxylated nonylphenols which are characterized not only by their hydrophilic character but also by cloud points above 30° C., as defined in terms of the standard DIN 53917 using a 1% by weight aqueous solution. A combination of these characteristics has in fact made it possible not only to obtain high-performance emulsifying systems for the preparation of a water/fuel emulsion in terms of the invention, but also to obtain totally remarkable temperature resistance properties capable of stabilizing this emulsion over a wide temperature range.

Other examples of compounds (III) which may be mentioned are polyethoxylated octylphenols, particularly those marketed under the trade mark OCTAROX® (SEPPIC) or SINNOPAL $OP_n$® (SIDOBRE-SINNOVA).

In one preferred variant of the invention, the compound (III) of the emulsifying system is a mixture of polyethoxylated nonylphenols, preferably of two polyethoxylated nonylphenols having 9 and 12 ethylene oxide residues respectively.

Without implying a limitation, the fuels to which the present invention relates more specifically are those in which the hydrocarbon or mixture of hydrocarbons forming part of their constitution is selected from the following group of products: diesel fuels, petrols, kerosenes, heating oils, synthetic engine fuels, esterified or non-esterified vegetable oils, and mixtures thereof.

Even more preferably, the present invention relates to the particular group of fuels comprising the engine fuels (diesel fuels, petrols, kerosenes, synthetic engine fuels, esterified or non-esterified vegetable or animal oils) which are employed as fuels in internal combustion engines or heat engines.

Apart from the hydrocarbons, the water and the emulsifying system, a number of products serving a variety of purposes can be added to the engine fuel or other fuel according to the invention.

In this context, one of the major advantages of the hydrocarbon/water emulsions according to the present invention is that they offer two different types of carrier for the additives, namely a lipophilic carrier consisting of the hydrocarbon continuous phase and a hydrophilic carrier consisting of the aqueous phase. This considerably widens the possibilities for introducing active additive compounds. In fact, previously only oil-soluble compounds could easily be incorporated into engine fuels and other fuels. This constraint is now eliminated by means of the present invention, especially as the number of products soluble in water is very much greater than the number of products soluble in fuels in terms of the invention.

Thus it can be envisaged, according to the invention, to give the emulsified engine fuel or other fuel an octane-improving function by using additives which are soluble or miscible in water or in hydrocarbons. These additives can therefore consist of one or more octane-improving products preferably selected from peroxides and/or nitrates and mixtures thereof. Alkyl nitrates are examples of cetane improvers which can be incorporated into the emulsion via the hydrocarbon phase. Nitrate salts are the hydrophilic counterparts of alkyl nitrates. Their salt character enables them to be carried by the aqueous phase.

A soot inhibiting function is another function which the emulsified fuels of the invention can be given. The promoters of said function are advantageously additives consisting of at least one metal or alkaline earth metal catalyst and capable of favoring the postcombustion reaction of soots, said catalyst preferably being based on magnesium, calcium, barium, cerium, copper, iron or a mixture thereof. These catalytic promoters of soot destruction are all the easier to introduce because they are generally compounds whose salts are water-soluble, making them compatible with the aqueous phase of the emulsions according to the invention. The same does not apply to the conventional fuels of the prior art, which consist exclusively of hydrophobic hydrocarbons.

In one variant of the invention, it can be advantageous to confer biocidal or even bactericidal properties on the emulsified fuels. The latter can therefore optionally comprise at least one biocide, preferably bactericide.

A detergent function can also prove valuable for the emulsions according to the invention. It is therefore appropriate to envisage the case where said emulsions comprise one or more detergents or detergent additives.

A nitrogen oxide ($NO_x$) inhibiting function, which can be provided by ammoniated compounds (of the urea or aqueous ammonia type), is also prized in fuels and more particularly engine fuels.

An antifreeze function can also be added or emulsified fuel by means of antifreeze additives such as glycols or salt solutions.

More precisely, a practical example of the composition of an emulsified fuel according to the invention is given below:

hydrocarbon(s) 50 to 99%, preferably 65 to 99%, water 0.1 to 50%, preferably 1 to 35%, emulsifying system 0.05 to 5%, preferably 0.1 to 3%, additives 0.01 to 5%, preferably 0.05 to 2%.

Furthermore, the present invention is perfectly in line with the current trend to use "green petrol" as a partial substitute for engine fuel, especially diesel. Thus it can advantageously be envisaged to incorporate at least one esterified or non-esterified vegetable or animal oil and/or at least one extract thereof, preferably at a rate of 1 to 60% by weight.

Possible examples are esterified or non-esterified colza, soya or sunflower oils, which can be incorporated into the fuel composition in proportions of 5%, 30% or even 50% by weight, for example.

The present invention further relates to an additive composition for engine fuel, comprising essentially:

the emulsifying system described above and optionally at least one other additive preferably selected from the products described below, namely: cetane improvers, catalytic promoters of soot combustion, biocides, detergents, ammoniated compounds, antifreezes, esterified or non-esterified vegetable oils, and mixtures thereof.

According to another of these aspects, the present invention relates to a method of preparing an emulsified fuel, characterized in that it consists essentially of the following steps carried out in a simultaneous or non-simultaneous manner:

a—taking at least one hydrocarbon, water and an emulsifying system comprising:

Δ (I) at least one sorbitol ester of the general formula (I)

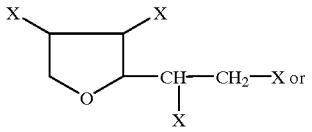

(I')

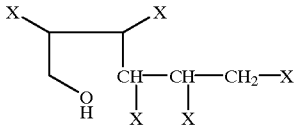

in which:

the radicals X are identical to or different from one another and are each OH or $R^1COO$—, where $R^1$ is a linear or branched, saturated or unsaturated, aliphatic hydrocarbon radical optionally substituted by hydroxyls and having from 7 to 22 carbon atoms, $R^1$ preferably being a fatty acid residue without a terminal carboxyl, this ester (I) having an HLB of between 1 and 9;

Δ (II) at least one fatty acid ester of the general formula (II)

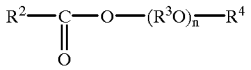

in which:

$R^2$ is a linear or branched, saturated or unsaturated, aliphatic hydrocarbon radical optionally substituted by hydroxyl groups and having from 7 to 22 carbon atoms, $R^2$ preferably being a fatty acid residue without a terminal carboxyl, $R^3$ being a linear or branched $C_1$–$C_{10}$ alkylene, preferably $C_2$–$C_3$ alkylene, n is an integer greater than or equal to 6 and preferably between 6 and 30, and $R^4$ is H, linear or branched $C_1$–$C_{10}$ alkyl or

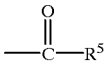

where $R^5$ is as defined above for $R^2$, this ester (II) preferably having an HLB greater than or equal to 9;

Δ (III) and/or at least one polyalkoxylated alkylphenol of the general formula

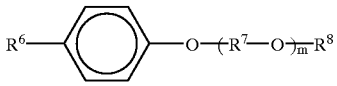

in which:

$R^6$ is a linear or branched $C_1$–$C_{20}$ alkyl, preferably $C_5$–$C_{20}$ alkyl, m is an integer greater than or equal to 8 and preferably between 8 and 15, and $R^7$ and $R^8$ are respectively defined as above for $R^3$ and $R^4$ of formula (II), this ester (III) preferably having an HLB of between 10 and 15, this emulsifying system having an HLB of between 6 and 8, preferably of between 6.5 and 7.5;

Δ and optionally other additives;

b—mixing these constituents to form a water-in-oil emulsion;

c—and fractionating the emulsion to reduce the size of the droplets of aqueous disperse phase to a mean size less than or equal to 3 μm, preferably 2 μm and particularly preferably 1 μm, with a standard deviation of less than 1 μm.

The method according to the invention can therefore be summarized as the formation of an emulsion and the fractionation of this emulsion to reduce the size of the droplets of aqueous disperse phase until a monodisperse particle size of 1 μm is obtained and maintained, with a standard deviation of less than 1 μm.

The emulsification largely depends on the emulsifying system. The latter preferably has the following composition:

(I) from 2.5 to 3.5 parts by weight, preferably 3 parts by weight, (II) from 1.5 to 2.5 parts by weight, preferably 1.5 to 2 parts by weight, (III) from 0.5 to 1.9 parts by weight, preferably 0.5 to 1.5 parts by weight.

The method according to the invention can be one of those which may be used to prepare the improved emulsified fuel (e.g. engine fuel) described above. It follows by extension that the characteristics and observations given in the above description in the context of the products used in the emulsion can be carried over in their entirety into this part of the disclosure relating to the method.

The fractionation of the emulsion is a mechanical or thermomechanical treatment aimed at breaking the cohesive force between the droplets so as to promote their subdivision. The fractionating means which are preferably employed in step (c) are of the types comprising a static mixer, a centrifugal pump or other type of pump, a colloid mill or other type of mill, a rotary mixer, an ultrasonic mixer and other means of fragmenting one liquid in another, non-miscible liquid.

In practice, static mixers can be used as fractionating means. These static mixers are devices through which the emulsion is passed at high speed and in which said emulsion experiences sudden changes in direction and/or in the diameter of the channels which make up the interior of the mixers. This results in a pressure loss, which is a factor in obtaining a correct emulsion in terms of fineness and stability.

As other examples of means of manufacturing an emulsion, according to the intended scale of production, it is possible to use a rotary mixer of the type marketed under the trade mark ULTRA-TURRAX®, a high-pressure homogenizer of the type marketed by APV-BAKER, or any means known to those skilled in the art which affords an easy extrapolation of scale.

In one variant of the method of the invention, the mixing/fractionating steps b and c are for example sequential, i.e. the procedure consists in mixing the hydrocarbon(s), the emulsifying system and, if appropriate, the additives in a first stage, the premix being mixed and emulsified with the water in a second stage.

In another variant of the method of the invention, provision is made for carrying out steps -a- to -c- in a continuous mode.

Steps -a- to -c- of the method according to the invention take place at room temperature, which is also the temperature of the fluids and raw materials used.

INDUSTRIAL APPLICATION

In view of these advantages in terms of stability, low polluting capacity, low consumption and price, the emulsified fuel according to the invention and/or obtained by the method according to the invention is destined for many industrial and commercial applications.

The principal target sector, although this is not exclusive, is that of engine fuels and particularly diesel fuel. It should now therefore be possible to offer the owners of vehicles or other machines with a heat engine (e.g. diesel engine) emulsified fuels comprising from 5 to 15% by weight of water, without it being necessary to modify the engine settings.

Moreover, after a few relatively minor adaptations, the engines will be able to run efficiently, economically and with low pollution on emulsified fuels comprising from 35 to 45% by weight of water.

This represents a considerable technical advance in the field of engine fuels.

Spin-offs can also be expected in the field of fuels for heat machines such as boilers, furnaces, gas turbines, generators, etc. The fuel concerns can be heating oil in such cases.

The present invention will be understood more clearly from the following Examples describing the preparation and the structural and functional characterization of the emulsified engine fuels according to the invention, and from the comparative tests showing the superiority of the emulsions according to the invention over the nearest prior art. These Examples also highlight all the advantages and variants of these hydrocarbon/water emulsions.

The Examples are illustrated with the aid of FIGS. 1 to 4 attached.

DESCRIPTION OF THE FIGURES

FIG. 5 shows a graph of the monodisperse particle size distribution of an emulsified engine fuel according to the invention, in which the mean diameter $\bar{d}$ of the droplets of aqueous phase is plotted on the abscissa and $\Delta N/N$ is plotted on the ordinate, N being the total number of droplets and $\Delta N$ being the number of droplets of a given $\bar{d}$.

FIG. 6 shows the cycles of variations in temperature and agitation which are applied to the summer formulation (FIG. 6.1) and winter formulation (FIG. 6.2) in order to determine their stability in use.

EXAMPLES

Example I

Figure 1:
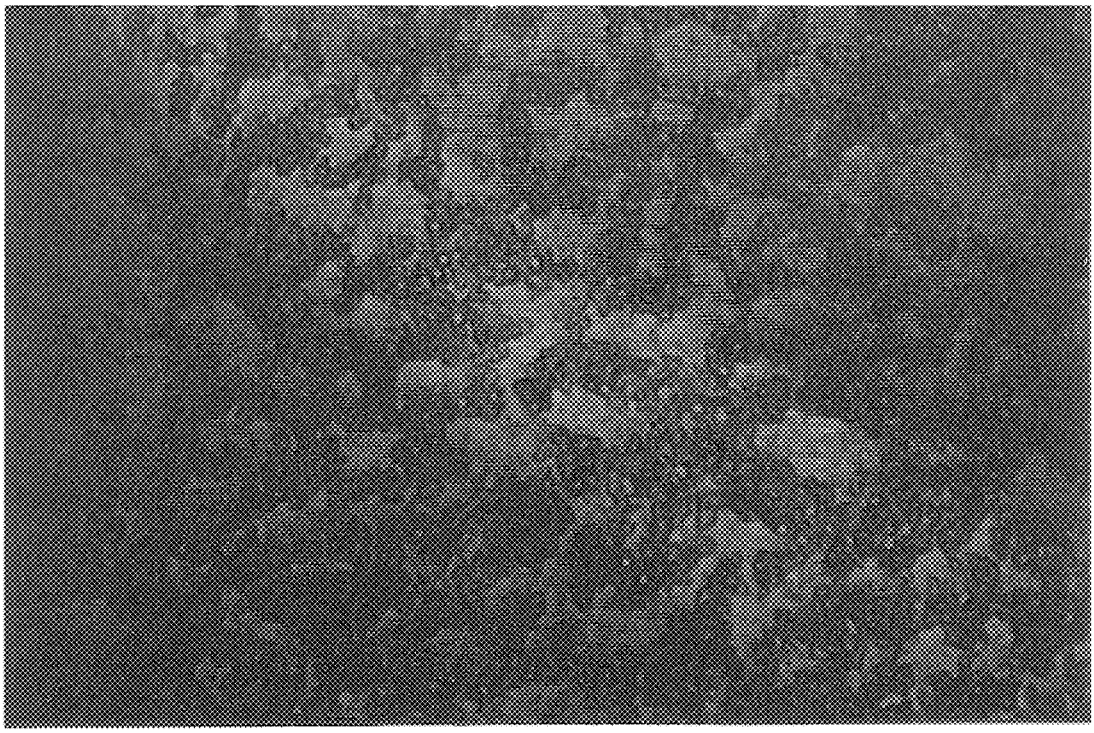
FIG. 1 shows an optical micrograph, at a given magnification, of a water/diesel fuel emulsion according to the invention, the size of the droplets of aqueous disperse phase being less than or equal to 1 $\mu$m.

Using the above-mentioned method integrating steps a), b) and c), several emulsions were prepared with different compositions of the emulsifying system. For comparison purposes, the total amount of surfactants was kept constant at 1.86% by weight, based on the total weight of the emulsion. The total amount of aqueous solution (water+optional water-soluble additives such as biocides or an antifreeze) is constant at 13% by weight in all the formulations. The standard formulation is given in detail in Table 1.

TABLE 1

Formulation used for the Comparative Examples

| Compound | Reference (supplier) | Composition (% by weight) |
|---|---|---|
| Cetane improver | RV 100 (ELF ANTAR FRANCE) | 0.87 |
| Emulsifying system | according to the Examples | 1.86 |
| Water | according to the Examples | 13* |
| Diesel fuel | CEC RF 0387 | 84.27 |
| Biocide for diesel fuel | EB 7301 (ELF ANTAR FRANCE) | A** |
| Biocide for water | EB 301 W (ELF ANTAR FRANCE) | B*** |

*10% by weight of MEG (monoethylene glycol) is added to the water in the winter formulation.
**A: dose of 1 part per 1000, based on the volume of diesel fuel
***B: dose of 2 parts per 1000, based on the volume of water The compositions of the emulsifying systems tested are given in Table 2. In Table 2, the compositions have been shown in the form of the proportions by weight of each of the constituents of the emulsifying system, it being pointed out that said system represents 1.86% by weight of the final emulsion formulation.

The following can be specified for the interpretation of Table 2:

- compositions A to F are the compositions of the invention,
- composition G is the composition described in WO-93/18117,
- compositions H to L serve as Comparative Examples demonstrating the superiority of the compositions of the invention over those containing only two of the constituents or those whose HLB is outside the range claimed.

TABLE 2

| Composition Surfactant | A | B | C | D | E | F | G | H | I | J | K | L |
|---|---|---|---|---|---|---|---|---|---|---|---|---|
| Sorbitan sesquioleate | 3 | 3 | | 1.5 | 1.5 | 1.5 | 1 | | | | 1.5 | 1 |
| Sorbitan monooleate | | | 3 | | | 1.5 | | 1.5 | 1.5 | 1.5 | | |
| Sorbitan laurate | | | | 1 | | | | | | | 1.5 | |
| Sorbitan stearate | | | | | 1.5 | | | | | | | |
| PEG 300 | | | | | | | 1 | | | | | |
| PEG 300 monooleate | 2 | | 2 | 2 | 2 | 1 | | | | | 2 | 2 |
| PEG 600 monooleate | | | | | | | | 1 | | | | |
| PEG 300 ricinoleate | | 2 | | | | 1 | | | | | | |
| Nonylphenol ethoxylated with 9 EO | 1 | 1.5 | 1 | 1 | 1 | 1.5 | 1 | | | | | 3 |
| Nonylphenol ethoxylated with 12 EO | 0.5 | | 0.5 | | | | | | 1 | | | |
| Nonylphenol ethoxylated with 30 EO | | | | | | | | | | 1 | 1.5 | |
| Octylphenol ethoxylated with 9 EO | | | | | 0.5 | | | | | | | |
| HLB of the emulsifying system | 7.5 | 7.7 | 7.6 | 6.5 | 7.8 | 7.9 | 8.2 | 10.1 | 8.1 | 9.2 | 9.6 | 10.1 |

The quality of the emulsion obtained is characterized by the criteria below.

Particle Size Criterion

This is established from the homogeneous appearance of the water droplets dispersed in the diesel fuel continuous phase, with a low polydispersity and a mean particle size of less than 1 μm, the standard deviation being less than 1 μm, established by image analysis from micrographs.

Stability Criterion

This is a dual criterion and relates to the stability under use conditions (dynamic character) and the storage stability at different temperatures.

Stability in Use

This is characterized by the absence of demixing/settling or other breaking of the emulsion observed on a 1-liter sample placed in a flat-bottomed glass vessel (of the beaker type) and subjected to a cycle simulating the changes in temperature of the engine fuel in a tank. Demixing is said to take place when the volume of the supernatant, corresponding to a separation of the diesel fuel, is greater than 5% of the total volume of the sample, or when water appears at the bottom of the beaker.

The profile of the temperature variation cycle is illustrated for each formulation, <<summer>> and <<winter>>, in FIG. 6. It will be noted that the system must be agitated (gentle mechanical agitation, about 60 rpm) or at rest, depending on the phase of the cycle. FIG. 6.1 illustrates the cycle for the summer formulation and FIG. 6.2 illustrates the cycle for the winter formulation.

Storage Stability

This is characterized by the absence of demixing/settling in 3 samples after 3 months of static storage in conical flasks placed at 0° C., 20° C. and 40° C. respectively. These criteria were applied to the formulations obtained from compositions A to L as described in Table 3. The results are given in Table 3. A solution of methanol (MeOH) in water, or a solution of colza methyl ester (CME) in diesel fuel, is also added to some of the formulations, the percentages in each case being expressed by volume relative to the volume of the total formulation.

TABLE 3

| Composition | A | A | A | B | C | D | E | F | G | H | I | J | K | L |
|---|---|---|---|---|---|---|---|---|---|---|---|---|---|---|
| Formulation | summer | winter | summer | summer | summer | summer | summer | summer | summer | summer | summer | summer | summer | summer |
| Specific additive | — | — | 5% CME | — | — | — | — | — | — | 7% MeOH | 7% MeOH | 7% MeOH | — | — |
| Dispersity | mono | mono | mono | mono | mono | mono | mono | mono | poly | poly | poly | poly | poly | poly |
| Particle size ($\bar{d}$) | 1 μm | 1 μm | 1 μm | 1 μm | 1 μm | 1 μm | 1 μm | 1 μm | 1–10 μm | 1–20 μm | 1–20 μm | 1–20 μm | 1–20 μm | 1–20 μm |
| Stability in use | yes | yes | yes | yes | yes | yes | yes | yes | no | no | no | no | no | no |
| Storage stability | | | | | | | | | | | | | | |
| at 0° C. | 4 w | 3 m | 3 w | 4 w | 4 w | 3.5 w | 4 w | 4 w | 1 h | 1 h | 1 h | 1 h | 1 h | 1 h |
| at 20° C. | 3 m | 3 m | 3 m | 3 m | 3 m | 6 w | 3 m | 3 m | 2 w | 1 d | 1 d | 1 d | 2 h | 2 h |
| at 40° C. | 3 m | 4 w | 3 m | 6 w | 3 m | 4 w | 3 m | 6 w | 1 d | 1 h | 1 h | 1 h | 1 h | 1 h |

The following abbreviations have been used in Table 3:

h=hour d=day w=week m=month

The storage stability is assessed by the length of time taken for the formulation to exhibit the phenomenon of demixing.

Example II

PREPARATION OF A DIESEL FUEL/WATER/ EMULSIFYING SYSTEM EMULSION (ACCORDING TO THE INVENTION AND ACCORDING TO THE NEAREST PRIOR ART)

II.1. EMULSION ACCORDING TO THE INVENTION (3:2:1 EMULSION)

STEP -a-

II.1.1. The following starting materials are used to prepare 200 kg of emulsion:

164 kg of diesel fuel, 4 kg of emulsifying system (ES), 2 kg of an cetane improver of the alkyl nitrate type marketed under the reference CI 0801 by OCTEL, 30 kg of mains water.

II.1.2. Preparation of the emulsifying system:

The 4 kg of emulsifying system are obtained by mixing the following for a few minutes in a propeller mixer rotating at a few hundred rpm:

3 parts by weight, i.e. 2 kg, of SORBITHOM® S06 marketed by UNION DERIVAN SA, 2 parts by weight, i.e. 1.333 kg, of polyethylene glycol monooleate of trade mark TILOL® 163 marketed by UNION DERIVAN SA, 1 part by weight, i.e. 0.666 kg, of nonylphenol ethoxylate of the type marketed under the trade mark NONIL-FENOL® 9M OXIETIL® by UNION DERIVAN SA.

This emulsifying system has an HLB of 7.2.

STEPS -b- and -c-: PREMIXING, EMULSION FORMATION AND FRACTIONATION

The 4 kg of emulsifying system are incorporated into the 164 kg of diesel fuel and this mixture is homogenized for a few minutes with the propeller agitator rotating at a speed of a few hundred rpm. During agitation, the 2 kg of cetane improver are added, the 30 kg of water being added just before the fractionation described below.

Figure 3:
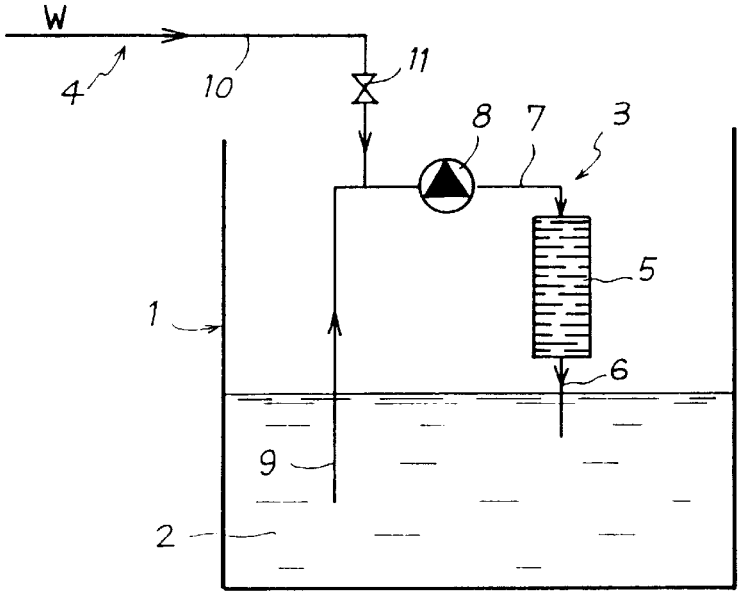
FIG. 3 shows a diagram of an example of an emulsion fractionating device which can be used in the method according to the invention.

The device used is the one shown in FIG. 3. This device consists of:

a vessel 1 for containing a liquid 2 made up of all the constituents of the emulsion except for the water before fractionation, or made up of the stabilized emulsion at the end of fractionation, fractionating means 3 stricto sensu, and a water (W) feed circuit 4.

The vessel 1 is a conventional container which is fed continuously or discontinuously with diesel fuel/emulsifying system/additive premix.

The fractionating means 3 consist of a static mixture 5 of the SMV—4DM 20 type (5 mixing elements in series) marketed by SULZER. This mixer consists of a hollow cylinder having an inlet and an outlet for fluid and defining, inside the cylinder, a zig-zag path for the fluid, said path being created by several stages of transverse partitions provided with oblique slots forming channels for the passage of fluid. The outlet of the static mixer 5 is connected to a pipe 6 coming out inside the vessel 1 (means 6 of carrying the outflow into the vessel 1), while its inlet is connected to a pipe 7 equipped with a pump 8. The free end 9 of this pipe 7 is immersed in the bath of premix or emulsion 2 contained in the vessel 1. Upstream and in the vicinity of the inlet of the pump 8, it is also connected to a water feed pipe 10, which, with the valve 11, forms the circuit 4 referred to above. This device is capable of ensuring a large pressure loss, at nominal flow rate, so as to cause dispersion of the emulsion.

Fractionation by means of this device is effected in the following manner: After the vessel 1 has been filled with the diesel fuel/ES/additive premix, the pump 8 is switched on so as to cause fluid to circulate through the static mixer 5. The electrovalve 11 is then opened in order to ensure that water is fed in and mixed with the DF/ES/A premix inside the pump 8, this mixture then being carried to the static mixer, where it undergoes the desired fractionation. The pressure of the fluid at the outlet of the pump 8 is 5 MPa.

In the present Example, the 30 kg of water are introduced in about 1 min. The system operates in a loop to ensure fractionation for 30 min. This gives 200 kg of emulsion corresponding to the characteristics of the invention. This emulsion is whitish in color and has a kinematic viscosity of 6.2 $mm^2/s$ at 20° C.

II.2. EMULSION ACCORDING TO THE PROPORTIONS OF THE PRIOR ART (1:1:1 EMULSION)

200 kg of emulsion are also prepared with 164 kg of diesel fuel, 4 kg of emulsifying system, 2 kg of additives consisting of magnesium oxide and toluene, and 30 kg of water.

The proportions of SORBITHOM® S06: TILOL 163®: NONILFENOL® 9M OXIETIL® are 1:1:1 rather than 3:2:1 as in section II.1. above. This emulsifying system has an HLB of 8.7.

The operating protocol employed is the one described in PCT patent application WO 93/18 117.

THE 200 KG OF EMULSION THUS OBTAINED ARE WHITISH IN COLOR.

Example III

STRUCTURAL AND FUNCTIONAL CHARACTERIZATION OF EMULSIONS I.1. AND I.2. OF EXAMPLE I

A—STABILITY

1—Microscopic Observations

Figure 2:
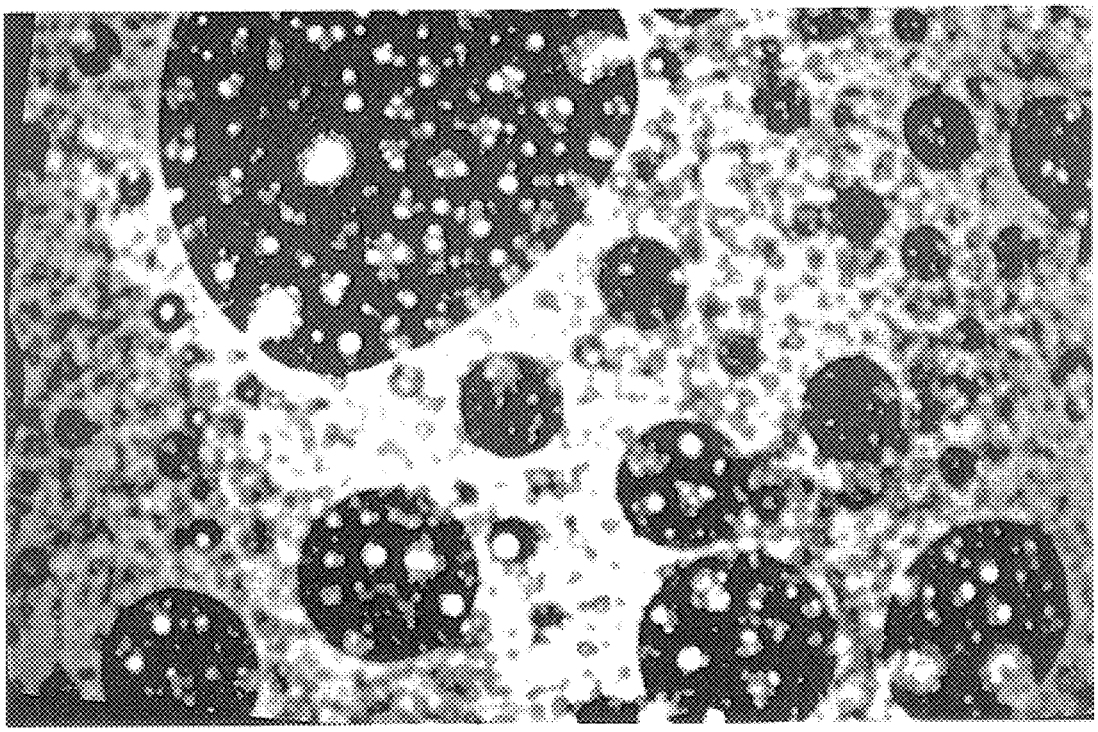
FIG. 2 shows an optical micrograph, at the same magnification as that of FIG. 1, of a water/diesel fuel emulsion according to the nearest prior art, the size of the droplets of aqueous disperse phase being greater than or equal to 10 $\mu$m.

FIGS. 1 and 2 attached clearly show the difference in size profile of the droplets of aqueous disperse phase. In the case of emulsion II.1., it is possible to observe a homogeneity in the diameter of the droplets with a maximum value of the order of 1 $\mu$m, which establishes the monodispersion of the droplets. In contrast, the known water droplets of emulsion II.2. show a very large size disparity with the majority of droplets having a size greater than 5 $\mu$m and an appreciable proportion of droplets having a size greater than 10 $\mu$m.

2—Stability Tests During Actual Use on Public Transport Buses

The buses used for these tests are type R312 Renault Vehicules Industriels® vehicles whose diesel fuel tank has its take-off at the lowest point so as to prevent the injection pump from being cut off in the event of braking, cornering or a gradient.

A first bus is provided with 300 liters of the emulsion according to II.1. and a second, comparative bus is provided with 300 liters of the emulsion according to II.2.

Both buses perform an urban cycle of 100 km.

They are then rested for 48 hours.

The two buses are then restarted, both successfully. However, after idling for 15 to 30 seconds, the comparative bus stalls, but this is not the case of the bus whose fuel is formed of the emulsion according to the invention.

The stalling of the comparative bus is explained by the lack of stability of emulsion II.2., which has undergone dephasing due to settling under gravity during the 48-hour rest period. It follows that when fuel is drawn off at the bottom of the tank, large amounts of dephased water have been carried into the combustion chamber by the injection pump. These excessively large proportions of water cause the engine to stall irreversibly.

Furthermore, one may also give consideration to the perturbations which emulsions II.2. (unstable, in contrast to emulsions II.1. according to the invention) are capable of causing in the elements of the injection circuit of all diesel engines. Such circuits contain a filter with a cut-off of between 1 and 2 $\mu$m, corresponding to the operating clearance of the injection pump and the injector.

In the case where water drops whose diameter is greater than or equal to the filtration cut-off are brought into contact with the filter, they will be unable to migrate, or will have difficulty in migrating, through the pores of the filter, so water will be retained and will accumulate in the body of the filter, which is particularly detrimental. In addition, undesirable obstruction and clogging of the filter could also occur.

This phenomenon can be demonstrated ex situ by creating an emulsion circuit in a filter with a cut-off of 1–2 $\mu$m. Working at constant pressure, clogging can be assessed:

by measuring the pressure losses and the decreases in flow rate, and by collecting, at the bottom of the filter, water or water-rich emulsion taking the form of large droplets.

It should be noted that the phenomenon of water freezing which may occur under winter driving conditions could only increase the risks and rate of clogging if emulsions according to the prior art, comprising water droplets whose $\bar{d}$ is greater than 5 $\mu$m, are employed rather than emulsions according to the invention.

B. PROPERTIES OF THE WATER/DIESEL FUEL EMULSIONS II.1. ACCORDING TO THE INVENTION IN THE RUNNING OF DIESEL ENGINES

1. RVI 312 BUSES WITH A DIRECT INJECTION DIESEL ENGINE

Figure 4:
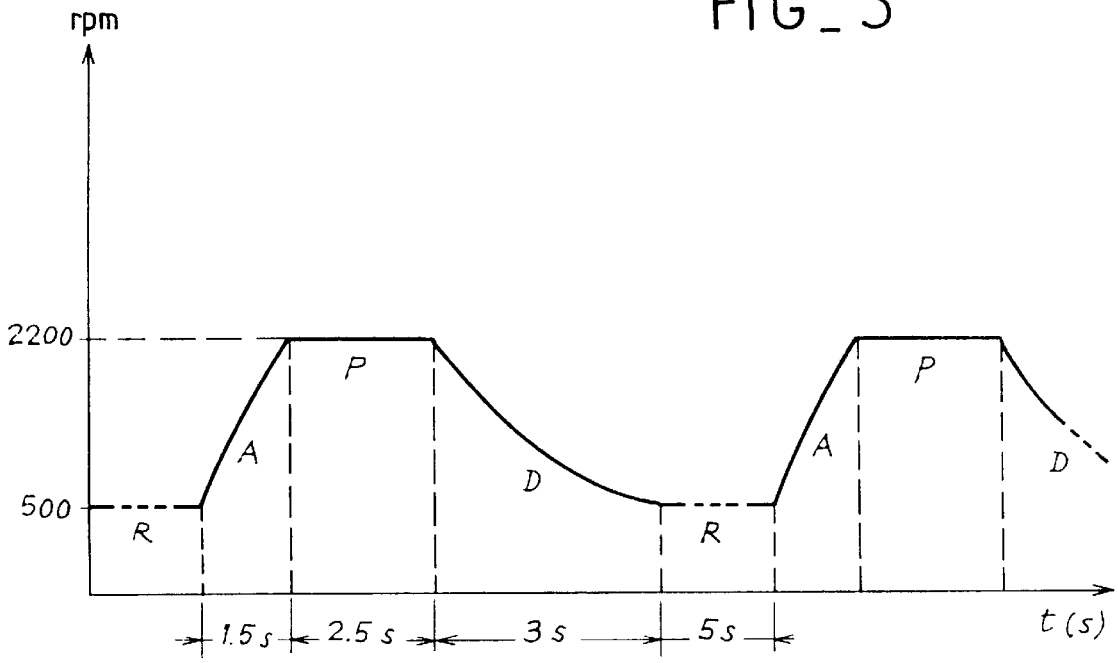
FIG. 4 shows a graph of an engine speed cycle (rpm) as a function of the time t (seconds), imposed on buses equipped with a diesel engine, for carrying out functional characterization tests on the emulsified engine fuels according to the invention and according to the prior art. (Example II)

A series of tests is carried out on the above-mentioned RVI R312 vehicles by subjecting them to a working cycle such as that shown in FIG. 4, comprising an idling phase R, an acceleration phase A, a full speed phase P (plateau) and a deceleration phase D. The speeds vary from 500 rpm in phase R to 2200 rpm in phase P. The duration of the phases RAPD of the cycle is given on the graph. Under the test conditions, this cycle is repeated a few dozen times on the RVI 312 vehicles.

1.1. Measurement of the Maximum Opacity of the Smoke During Phase A

This measurement is made with an (on-line) full flow opacimeter of the Technotest 490 type.

5 measurements are made with emulsion II.1. according to the invention and with pure diesel fuel as control. It should be noted that the diesel fuel employed to prepare the emulsion used is the same as the control diesel fuel.

The maximum opacity, expressed in $m^{-1}$, averages 3.51 for the pure diesel fuel and 1.22 for the emulsion according to the invention.

This represents a 65% reduction in opacity in favor of the emulsion according to the invention.

1.2. Mean Content of Invisible Pollutant (NO and CO) and Visible Pollutant (smoke)

(i) $NO_x$:

The measurements of this pollutant $NO_x$ were made by chemiluminescence with a COSMA analyzer.

As above, five measurements are made on pure diesel fuel and on emulsion II.1. prepared from a diesel fuel of the same origin as the pure diesel fuel used as control. The following results are obtained:

pure diesel fuel: 266 vpm (parts per million by volume)

emulsion: 224 vpm i.e. a 16% reduction.

(ii) CO:

The analyses of this pollutant in the exhaust were made with a COSMA analyzer using infrared absorption. The conditions were the same as in (i).

The following results are obtained:

diesel fuel: 475 vpm emulsion: 216 vpm i.e. a 33% reduction in CO.

(iii) Solid Particles:

The measurements of solid particles are made with a miniature dilution tunnel according to standardized method ISO 8178.

The conditions are the same as above.

The following results are obtained:

pure diesel fuel: 45.6 mg/$M^3$ emulsion: 29.6 mg/$m^3$ i.e. a 35% reduction in solid particles in favor of the emulsions according to the invention.

2. PEUGEOT 106—TYPE TU D5 INDIRECT INJECTION DIESEL ENGINE, ATMOSPHERIC VERSION

Tests are carried out with the Peugeot 106 vehicles referred to above, according to protocols standardized in the European Union for the approval of vehicles, namely: ECE (urban cycle) and EUDC (suburban cycle—engine hot).

The mean contents of pollutants are measured under these test conditions.

(i) NO:

diesel fuel: 0.64 g/km emulsion II.1. according to the invention: 0.54 g/km i.e. a 16% reduction.

(ii) Unburnt Hydrocarbons:

These measurements are made with a heated flame ionization analyzer under the standard conditions defined by the ECE/EUDC standards.

The following results are obtained:

pure diesel fuel: 0.08 g/km emulsion: 0.07 g/km i.e. an 8.8% reduction.

(iii) Solid Particles:

diesel fuel: 0.04 g/km emulsion II.1.: 0.02 g/km i.e. a 46% reduction.

Example IV

PREPARATION AND CHARACTERIZATION OF A WATER/DIESEL FUEL EMULSION CONTAINING 35% BY WEIGHT OF WATER

IV.1. PREPARATION

The composition of the emulsion prepared is as follows:

122 kg of diesel fuel, 4 kg of emulsifying system of the 3:2:1 type according to Example II.1. (2% of the emulsifying system), based on the total weight of the emulsion, 4 kg of CI 0801 cetane improver from OCTEL, 70 kg of water (35%).

The preparative protocol is the same as that given in Example II.1.

IV.2. CHARACTERIZATION

Effects are carried out on a test stand for a direct injection single-cylinder engine with a cubic capacity of the order of 500 $cm^3$.

The emulsion prepared in IV.1. is stable and has substantially the same size profile of aqueous droplets as the emulsion according to Example II.1.

The speed imposed on the engine during the tests is 2250 rpm with a mean effective pressure of 8.4 MPa (full load).

Measurements of polluting gases are made on the exhaust:

(i) Without Recirculation of Exhaust Gases to the Intake

The methods of measurement are the same as those mentioned above.

$NO_x$:

pure diesel fuel: 23.7 mg/s emulsion IV.1.: 11.0 mg/s i.e. a 54% reduction.

Smoke—BOSCH Point pure diesel fuel: 1.1 emulsion IV.1.: 0.2 i.e. an 82% reduction.

(ii) With 16.5% Recirculation of Exhaust Gases to the Intake $NO_x$:

pure diesel fuel: 7.95 mg/s emulsion IV.1.: 4.98 mg/s i.e. a 38% reduction.

Smoke—BOSCH Point diesel fuel: 3.6 emulsion IV.1.: 1.6 i.e. a 55% reduction in smoke.

A value of 3.6 is known to be unacceptable whereas a value of 1.6 is completely tolerable.

What is claimed:

1. Improved fuel comprising an emulsion of water in at least one hydrocarbon, ⇒this emulsion further including an emulsifying system comprising:

Δ (I) at least one sorbitol ester of the general formula (I)

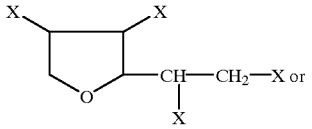

(I')

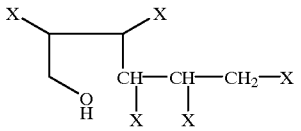

in which:

the radicals X are identical to or different from one another and are each OH or $R^1COO^-$, where $R^1$ is a linear or branched, saturated or unsaturated, aliphatic hydrocarbon radical optionally substituted by hydroxyls and having from 7 to 22 carbon atoms, provided that at least one of said radicals X is $R^1COO^-$, this ester (I) having HLB of between 1 and 9;

Δ (II) at least one fatty acid ester of the general formula (II)

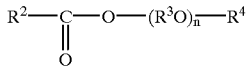

in which:

$R^2$ is a linear or branched, saturated or unsaturated, aliphatic hydrocarbon radical optionally substituted by hydroxyl groups and having from 7 to 22 carbon atoms, $R^3$ is a linear or branched $C_1$–$C_{10}$ alkylene, n is an integer greater than or equal to 6, and $R^4$ is H, linear or branched $C_1$–$C_{10}$ alkyl or

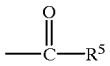

where $R^5$ is as defined above for $R^2$, and

Δ (III) at least one polyalkoxylated alkylphenol of the general formula (III)

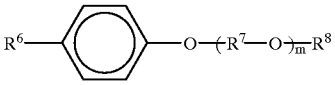

in which:

$R^6$ is a linear or branched $C_1$–$C_{20}$ alkyl, m is an integer greater than or equal to 8, and $R^7$ and $R^8$ are respectively as defined above for $R^3$ and $R^4$ of formula (II), ⇒the emulsifying system having an overall HLB of between 6 and 8; and ⇒the emulsion comprising droplets of aqueous disperse phase of means size less than or equal to 3 μm, with a standard deviation of less than 1 μm.

2. Fuel according to claim 1, wherein the emulsion comprises at least 5% by weight of water and the concentration of the emulsifying system relative to the fuel is less than or equal to 3% by weight,.

3. Fuel according to claim 1, wherein the emulsifying system comprises the compounds (I), (II) and (III) in proportions of:

(I) from 2.5 to 3.5 parts by weight, (II) from 1.5 to 2.5 parts by weight, and (III) from 0.5 to 1.9 parts by weight,.

4. Fuel according to claim 1, wherein:

(I) is a sorbitan oleate, (II) is selected from the group consisting of polyethylene glycol (PEG) oleates, stearates, ricinoleates, and mixtures thereof, and (III) is selected from the group consisting of polyethoxylated nonylphenols, octylphenols, and mixtures thereof.

5. Fuel according to claim 4, wherein the compound (II) of the emulsifying system is a mixture of polyethoxylated nonylphenols.

6. Fuel according to claim 1, wherein the hydrocarbon is selected from the group consisting of diesel fuels, petrols, kerosenes, heating oils, synthetic engine fuels, esterified or non-esterified vegetable or animal oils, and mixtures thereof.

7. Fuel according to claim 1, additionally comprising at least one octane-improving additive.

8. Fuel according to claim 1, additionally comprising the following additives:

at least one metal or alkaline earth metal catalyst for the postcombustion reaction of soots;

optionally at least one biocide; and optionally at least one glycol antifreeze.

9. Fuel according to claim 1, having the following composition, in weight %:

| | |
|---|---|
| hydrocarbon(s) | 50 to 99%, [preferably 65 to 99%,] |
| water | 0.1 to 50%, [preferably 1 to 35%,] |
| emulsifying system | 0.05 to 5%[, [preferably 0.1 to 2%,] |
| [additives] at least one additive | 0.01 to 5%[, preferably 0.05 to 2%]. |

10. Fuel according to claim 1, wherein the hydrocarbon comprises at least one esterified or non-esterified vegetable oil and/or at least one extract thereof.

11. Additive composition for fuel comprising:

Δ (I) at least one sorbitol ester of the general formula (I)

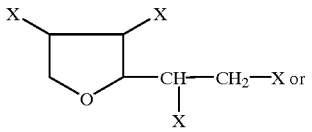

(I')

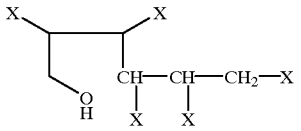

in which:

the radicals X are identical to or different from one another and are each OH or $R^1COO^-$, where $R^1$ is a linear or branched, saturated or unsaturated, aliphatic hydrocarbon radical optionally substituted by hydroxyls and having from 7 to 22 carbon atoms, provided that at least one of said radicals X is $R^1COO^-$, this ester (I) having HLB of between 1 and 9;

Δ (II) at least one fatty acid ester of the general formula (II)

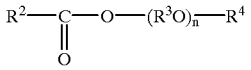

in which:

$R^2$ is a linear or branched, saturated or unsaturated, aliphatic hydrocarbon radical optionally substituted by hydroxyl groups and having from 7 to 22 carbon atoms, $R^3$ is a linear or branched $C_1$–$C_{10}$ alkylene, n is an integer greater than or equal to 6, and $R^4$ is H, linear or branched $C_1$–$C_{10}$ alkyl or

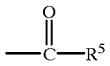

where $R^5$ is as defined above for $R^2$, and

Δ (III) at least one polyalkoxylated alkylphenol of the general formula (III)

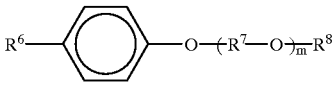

in which:

$R^6$ is a linear or branched $C_1$–$C_{20}$ alkyl, m is an integer greater than or equal to 8, and $R^7$ and $R^8$ are respectively as defined above for $R^3$ and $R^4$ of formula (II), ⇒this emulsifying system having an overall HLB of between 6 and 8; and ⇒the emulsion comprising droplets of aqueous disperse phase of means size less than or equal to 3 μm, with a standard deviation of less than 1 μm, and optionally at least one additive selected from the group consisting of cetane improvers, catalytic promoters of soot combustion, biocides, detergents, ammoniated compounds, antifreezes, and esterified or nonesterified vegetable and animal oils.

12. Method of preparing an emulsified fuel, comprising the following steps carried out in a simultaneous or non-simultaneous manner:

a—taking at least one hydrocarbon, water and an emulsifying system comprising:

Δ (I) at least one sorbitol ester of the general formula (I)

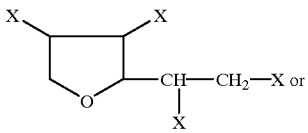

(I')

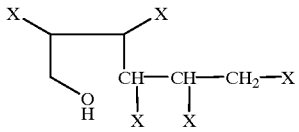

in which:

the radicals X are identical to or different from one another and are each OH or $R^1COO$—, where $R^1$ is a linear or branched, saturated or unsaturated, aliphatic hydrocarbon radical optionally substituted by hydroxyls and having from 7 to 22 carbon atoms, provided that at least one of said radicals X is $R^1COO^-$, this ester (I) having an HLB of between 1 and 9;

Δ (II) at least one fatty acid ester of the general formula

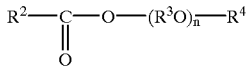

(II)

in which:

$R^2$ is a linear or branched, saturated or unsaturated, aliphatic hydrocarbon radical optionally substituted by hydroxyl groups and having from 7 to 22 carbon atoms, $R^3$ being a linear or branched $C_1$–$C_{10}$ alkylene, n is an integer greater than or equal to 6, and $R^4$ is H, linear or branched $C_1$–$C_{10}$ alkyl or

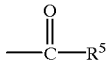

where $R^5$ is as defined above for $R^2$;

Δ (III) at least one polyalkoxylated alkylphenol of the general formula

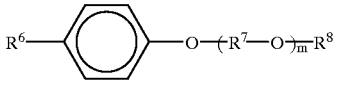

(III)

in which:

$R^6$ is a linear or branched $C_1$–$C_{20}$ alkyl, m is an integer greater than or equal to 8, and $R^7$ and $R^8$ are respectively defined as above for $R^3$ and $R^4$ of formula (II), this emulsifying system having an HLB of between 6 and 8;

Δ and optionally other additives;

b—mixing these constituents to form a water-in-oil emulsion; and c—fractionating the emulsion to reduce the size of droplets of aqueous disperse phase to a mean size less than or equal to 3 μm, with a standard deviation of less than 1 μm.

13. Method according to claim 12, wherein the emulsifying system has a composition comprising:

(I) from 2.5 to 3.5 parts by weight, (II) from 1.5 to 2.5 parts by weight, and (III) from 0.5 to 1.9 parts by weight,.

14. Method according to claim 12, wherein step-c- utilizes fractionating means selected from the group consisting of a sieve, a static mixer, a rotary mixer and an ultrasonic mixer.

15. Apparatus for carrying out the method according to claim 10, comprising:

at least one vessel (1) for containing a premix (2) of hydrocarbon, emulsifying system and additives and/or the emulsion comprising all or part of the water contained in the emulsion, means (3) for fractionating the emulsion, comprising at least one static mixer (5) having an inlet connected to a pipe (7), which is provided with at least one pump (8) and having a free end (9) constructed and arranged to be immersed in the premix (2) contained in the vessel (1), the mixer (5) having an outlet which is connected to means (6) for carrying outflow into the vessel (1), and a water feed circuit (4) comprising at least one further pipe (10) equipped with a valve (11) and connected to the pipe (7) upstream of the pump (8).

16. Fuel according to claim 1, wherein $R^1$ is a fatty acid residue without a terminal carboxyl.

17. Fuel according to claim 1, wherein $R^2$ is a fatty acid residue without a terminal carboxyl.

18. Fuel according to claim 1, wherein $R^3$ is $C_2$–$C_3$ alkylene.

19. Fuel according to claim 1, wherein n is between 6 and 30.

20. Fuel according to claim 1, wherein the ester (II) has an HLB greater than or equal to 9.

21. Fuel according to claim 1, wherein $R^6$ is $C_5$–$C_{20}$ alkyl.

22. Fuel according to claim 1, wherein m is between 8 and 15.

23. Fuel according to claim 1, wherein the ester (III) has an HLB of between 10 and 15.

24. Fuel according to claim 1, wherein the emulsifying system has an HLB of between 6.5 and 7.5.

25. Fuel according to claim 1, wherein the mean size of the droplets is less than or equal to 2 μm.

26. Fuel according to claim 1, wherein the mean size of the droplets is less than or equal to 1 μm.

27. Fuel according to claim 2, wherein the concentration of the emulsifying system is less than or equal to 2% by weight.

28. Fuel according to claim 3, wherein the compounds are present in an amount of:

(I) 3 parts by weight, (II) 1.5 to 2 parts by weight, and (III) 0.5 to 1.5 parts by weight.

29. Fuel according to claim 4, wherein:

(I) is sorbitan sesquioleate, (III) is a polyethoxylated nonylphenol, and the PEG of (II) has a molecular weight less than or equal to 450.

30. Fuel according to claim 5, wherein (II) comprises a mixture of a polyethoxylated nonylphenol having 9 ethylene oxide residues, and a polyethoxylated nonylphenol having 12 ethylene oxide residues.

31. Fuel according to claim 7, wherein the octane-improving additive is a peroxide, a nitrate or a mixture thereof.

32. Fuel according to claim 8, wherein the catalyst is based on magnesium, calcium, barium, cerium, copper, iron or a mixture thereof, and the biocide is a bactericide.

33. Fuel according to claim 9, wherein the hydrocarbon is present in an amount of 65 to 99% by weight, the water is present in an amount of 1 to 35% by weight, the emulsifying system is present in an amount of 0.1 to 3% by weight, and the at least one additive is present in an amount of 0.05 to 2% by weight.

34. Fuel according to claim 10, wherein vegetable oil and/or extract thereof is present in an amount of 1 to 60% by weight.

* * * * *